United States Patent [19]

Ifkovits, Jr.

[11] Patent Number: 5,022,638

[45] Date of Patent: Jun. 11, 1991

[54] ENVELOPE TRANSPORTING ALIGNING AND STACKING MODULE

[75] Inventor: Edward M. Ifkovits, Jr., New Fairfield, Conn.

[73] Assignee: Pitney Bowes Inc., Stamford, Conn.

[21] Appl. No.: 581,155

[22] Filed: Sep. 10, 1990

Related U.S. Application Data

[63] Continuation of Ser. No. 342,422, Apr. 24, 1989, abandoned.

[51] Int. Cl.[5] ..... B65H 5/00

[52] U.S. Cl. ..... 271/2; 271/251; 271/299; 271/305

[58] Field of Search ..... 271/2, 119, 250, 251, 271/297, 303-305, 299, 292

[56] References Cited

U.S. PATENT DOCUMENTS

| | | | |
|---|---|---|---|
| 3,235,940 | 2/1966 | Taylor et al. | 271/119 X |
| 3,674,143 | 7/1972 | Hunter et al. | 271/305 X |
| 3,970,299 | 7/1976 | Berger, Jr. et al. | 271/250 |
| 3,984,094 | 10/1976 | Stocker | 271/303 |
| 4,193,590 | 3/1980 | Mongagnino | 271/119 |
| 4,394,009 | 7/1983 | Bergman et al. | 271/119 X |
| 4,428,573 | 1/1984 | Denison, III et al. | 271/305 |
| 4,431,176 | 2/1984 | Deconinck | 271/119 X |
| 4,721,298 | 1/1988 | Pitcher, Jr. | 271/303 |
| 4,732,377 | 3/1980 | Fenske et al. | 271/303 |
| 4,775,142 | 10/1988 | Silverberg | 271/251 |

FOREIGN PATENT DOCUMENTS

| | | | |
|---|---|---|---|
| 0098447 | 6/1982 | Japan | 271/250 |
| 0093151 | 4/1987 | Japan | 271/119 |
| 0057440 | 3/1988 | Japan | 271/119 |

*Primary Examiner*—Robert P. Olszewski
*Assistant Examiner*—Boris Milef
*Attorney, Agent, or Firm*—Charles R. Malandra, Jr.; David E. Pitchenik; Melvin J. Scolnick

[57] ABSTRACT

A module for transporting, aligning, diverting and stacking a plurality of envelopes. The module includes: a housing frame; a registration wall secured to the housing frame; a fixed transport panel secured to the housing frame; a pivotable, envelope diverting transport panel situated upstream and adjacent the fixed transparent panel; a device for pivoting the pivotable panel between a horizontal plane and an acute angle with the horizontal plane; a stacking chamber secured to the housing frame situated beneath the fixed transport panel; and a roller assembly secured to the housing frame for transporting the envelopes in a downstream direction and for aligning the envelopes against the registration wall.

13 Claims, 12 Drawing Sheets

28
30
32
38
50
74
78
88
90
40
46
52
55
56

38
40
42
44
46
48
49
50
52
54
55
56
7
8

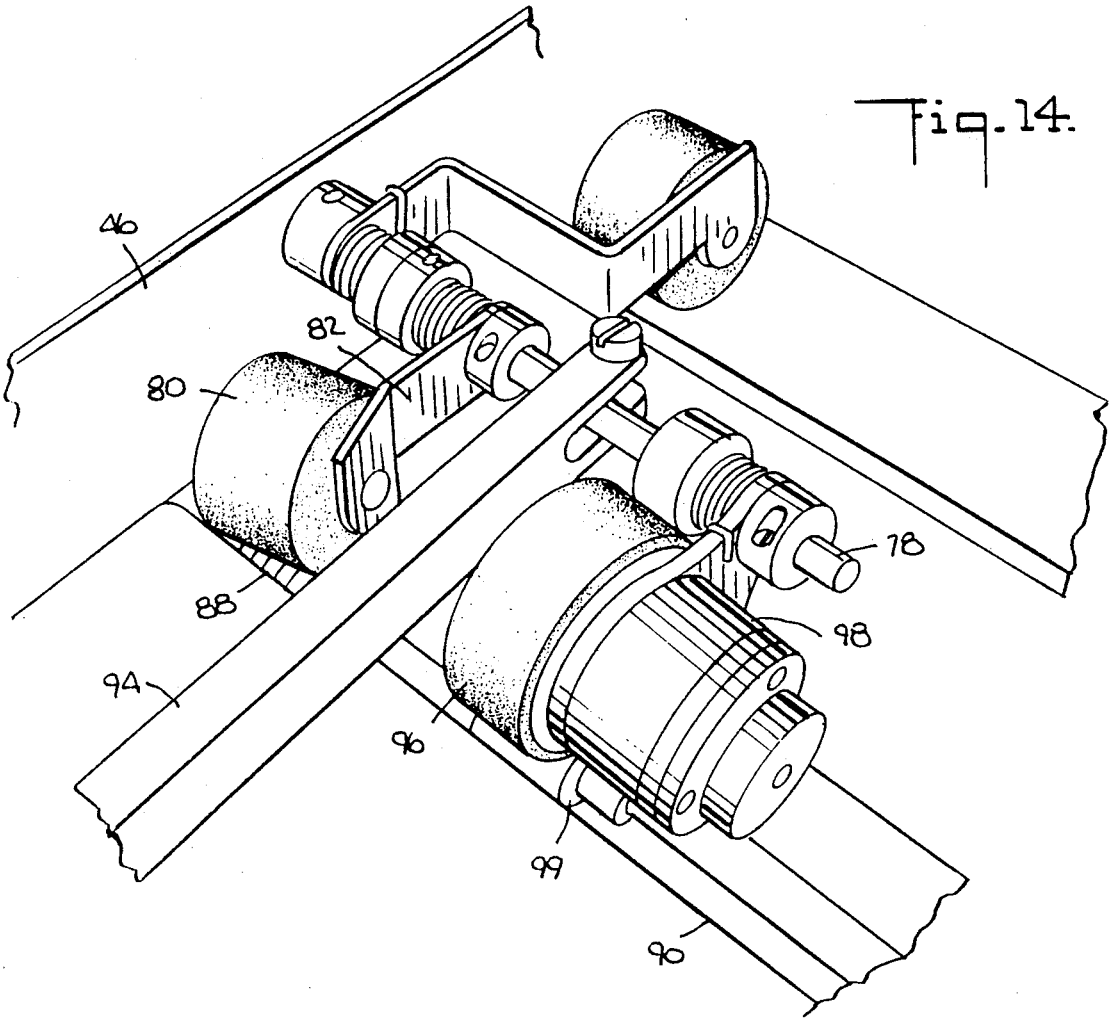
Fig. 14.
Fig. 15.
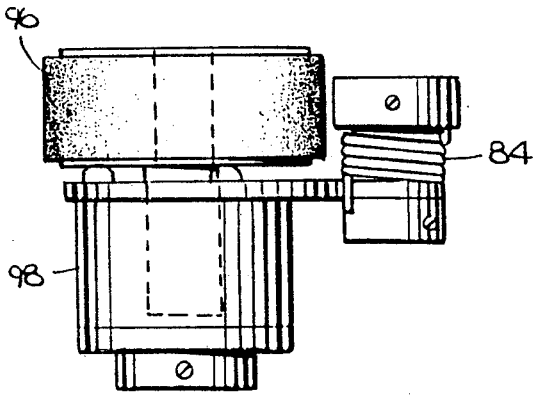
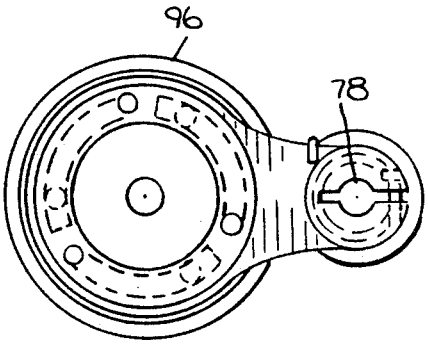
Fig. 16.

ENVELOPE TRANSPORTING ALIGNING AND STACKING MODULE

This application is a continuation, of application Ser. No. 07/342,422, filed Apr. 24, 1989, now abandoned.

BACKGROUND OF THE INVENTION

The instant invention relates to a modular device for transporting, aligning and stacking envelopes, and more particularly to such a device which can be combined with other like devices to provide any desired length of transport path and any desired number of stacking bins.

In high volume mailing applications, a plurality of documents are fed from document feeding devices to a location where they are inserted into an envelope. The envelopes are then transported seriatim from the document inserting position to another location for further processing, which typically includes the printing of postage on the envelopes. In many applications, it is desirable to separate the output of the inserter by diverting certain envelopes from the mainstream, or by directing certain envelopes, such as all those having the same zip code, to a designated collecting bin. When the objective is to print postage on the envelopes downstream of the inserting apparatus, it is necessary not only to transport the envelopes from the inserting apparatus to the postage meter or other printing device employed, but also to align the envelopes so that the printing occurs uniformly at the proper location on the envelopes.

There are available today various modules to perform each of the processes described hereinabove, i.e. transporting, aligning, diverting and stacking. These modules are situated at an appropriate location in the envelope path and perform their function as required. However, there is no single module available today which can be used to perform all of these tasks. Such a module obviously would provide significant cost savings to both the producer of the module and to the end user who would be able to simply purchase a plurality of similar modules and then deploy them as he saw fit.

Accordingly, the instant invention comprises a single module to be used in the envelope transport path which can be set up in a variety of formats and modified in order to perform the functions of transporting the envelopes, aligning the envelopes, stacking the envelopes and deflecting the envelopes out of the envelope path, all at a speed which does not slow down the inserting apparatus or the postage meter or other printing apparatus used to print the postage on the envelope.

SUMMARY OF THE INVENTION

Thus, the instant invention provides a universal module for transporting, aligning, diverting and stacking a plurality of envelopes, comprising: a housing frame; a registration wall secured to the housing frame; a fixed transport panel secured to the housing frame; a pivotable, envelope diverting transport panel situated upstream and adjacent the fixed transport panel; means for pivoting the pivotable panel between a horizontal plane and an acute angle with the horizontal plane; a stacking chamber secured to the housing frame situated beneath the fixed transport panel; and a roller assembly secured to the housing frame for transporting the envelopes in a downstream direction and for aligning the envelopes against the registration wall.

BRIEF DESCRIPTION OF THE DRAWINGS

FIG. 14 is an enlarged, perspective view of the braking roller assembly seen in FIGS. 12 and 13;

FIG. 15 is an enlarged, top plan view of the braking roller seen in FIG. 14;

FIG. 16 is a side elevational view of the braking roller seen in FIG. 15.

DESCRIPTION OF THE PREFERRED EMBODIMENT

Figure 1:
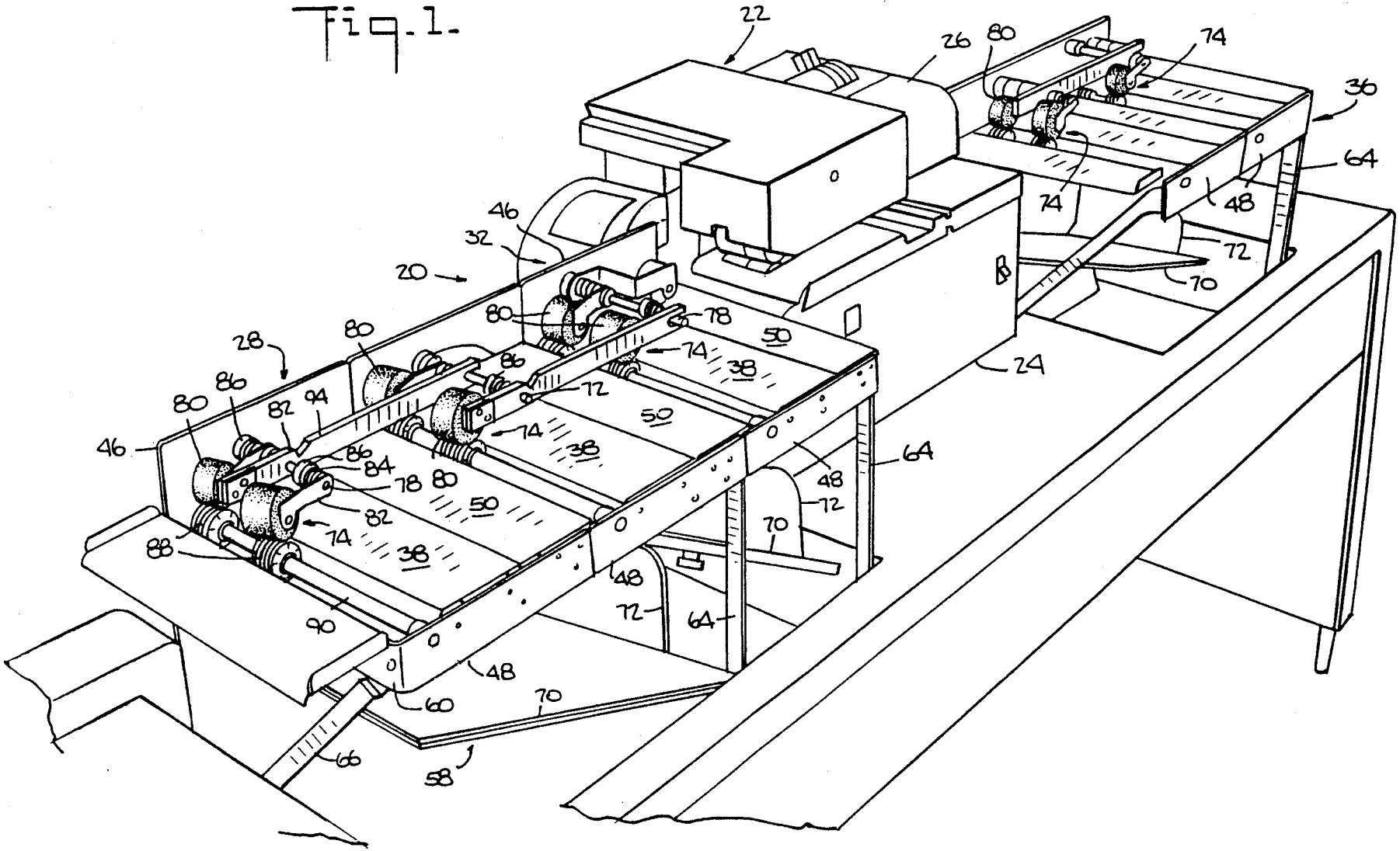
FIG. 1 is a perspective view of a mailing machine in line with two upstream units consisting of three universal modules and one downstream unit consisting of two modules in accordance with the instant invention.

In describing the preferred embodiment of the instant invention, reference is made to the drawings wherein there is seen in FIG. 1 an envelope transporting system generally designated 20 consisting of a mailing machine 22 having a base 24 and a postage meter 26 secured thereto. Upstream of the mailing machine 22 are three modules 28, 30 and 32 which are connected together to form two stacking units (to be discussed in more detail hereinbelow) and a transport path. Downstream of the mailing machine 22 are two modules 34 and 36 which are connected together to form one stacking unit and a transport path.

Each of the modules 28, 30, 32, 34 and 36 includes an envelope diverting deck panel 38 which is pivotable about its central axis on a pivot shaft 40 and a pivot stud 42 which engage flange portions 44 of the deck panel 38. The pivot shaft 40 is welded to the flange 44 of the panel 38, and is rotatably mounted through an aperture in the rear frame 46 which also functions as an aligning or registration wall. The pivot stud is rotatably mounted through an aperture in the front frame 48. Each of the modules 28, 30, 32, 34 and 36 includes downstream of the envelope diverting deck panel 38 a fixed transport panel 50. The shaft 40 is secured to a flexible coupling 52 which in turn is secured to a shaft 54 which is journalled in a supporting bracket 55 and engaged for rotation when a solenoid 56 (see FIG. 6) is actuated. The solenoid 56 is secured to the frame 46.

The pivotable deck 38 is easily pivoted by minimal force generated by the solenoid 56 so that the upstream portion of the panel 31 forms an acute angle with the horizontal. Preferably, the acute angle is between about 30 and 45 degrees. The flexible coupling 52 functions as a shock absorber which also aligns the axial shafts 40 and 54. It can be understood that the centroid location of the pivot of the deck panel 38 assures that the panel 38 will not lock on an envelope 76 which may be passing into a stacking chamber 58 (to be discussed in detail hereinbelow) situated beneath the panel 38.

Figure 4:
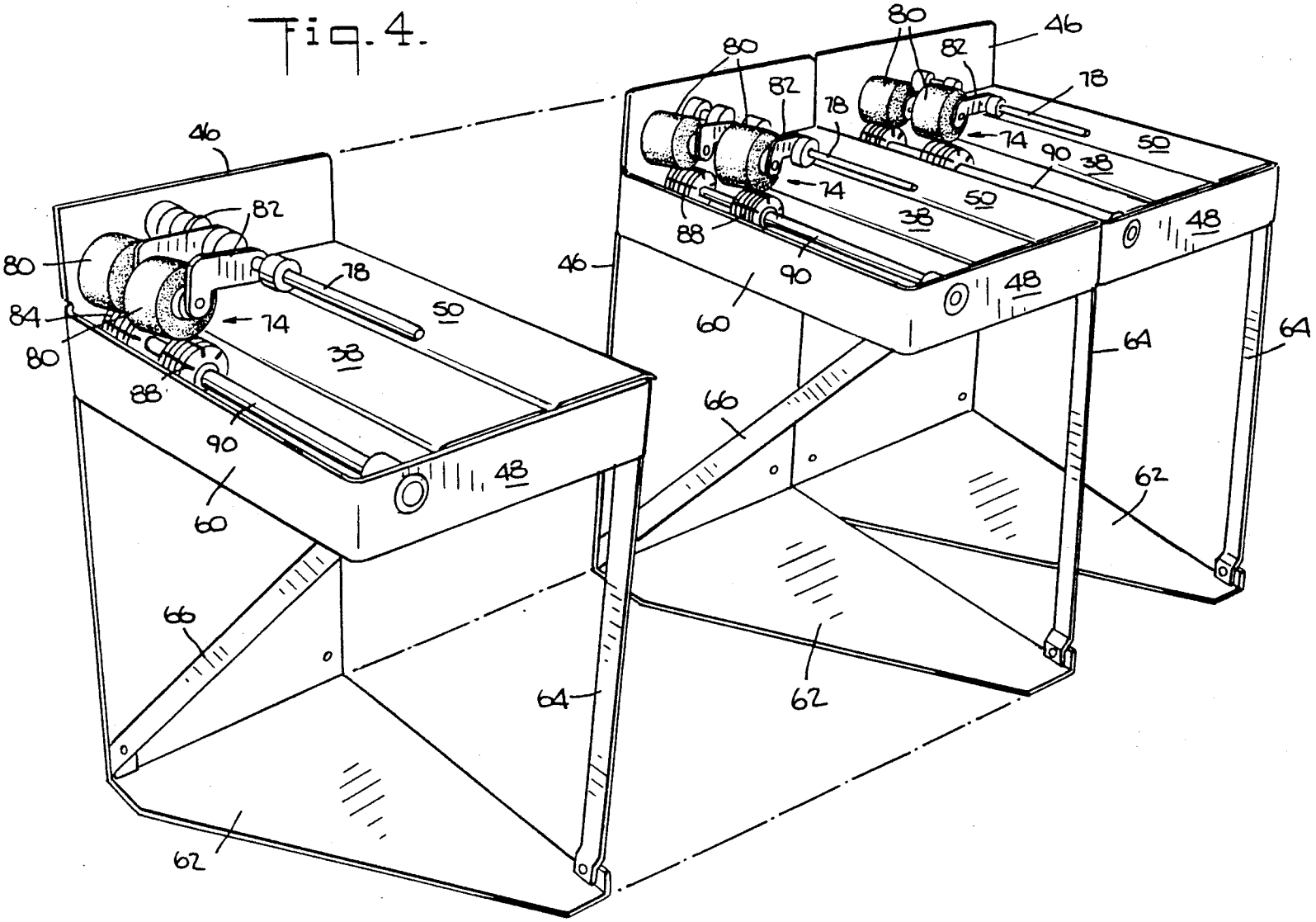
FIG. 4 is a perspective view of two modules connected together to form one unit and a stand-alone third module.
Figure 5:
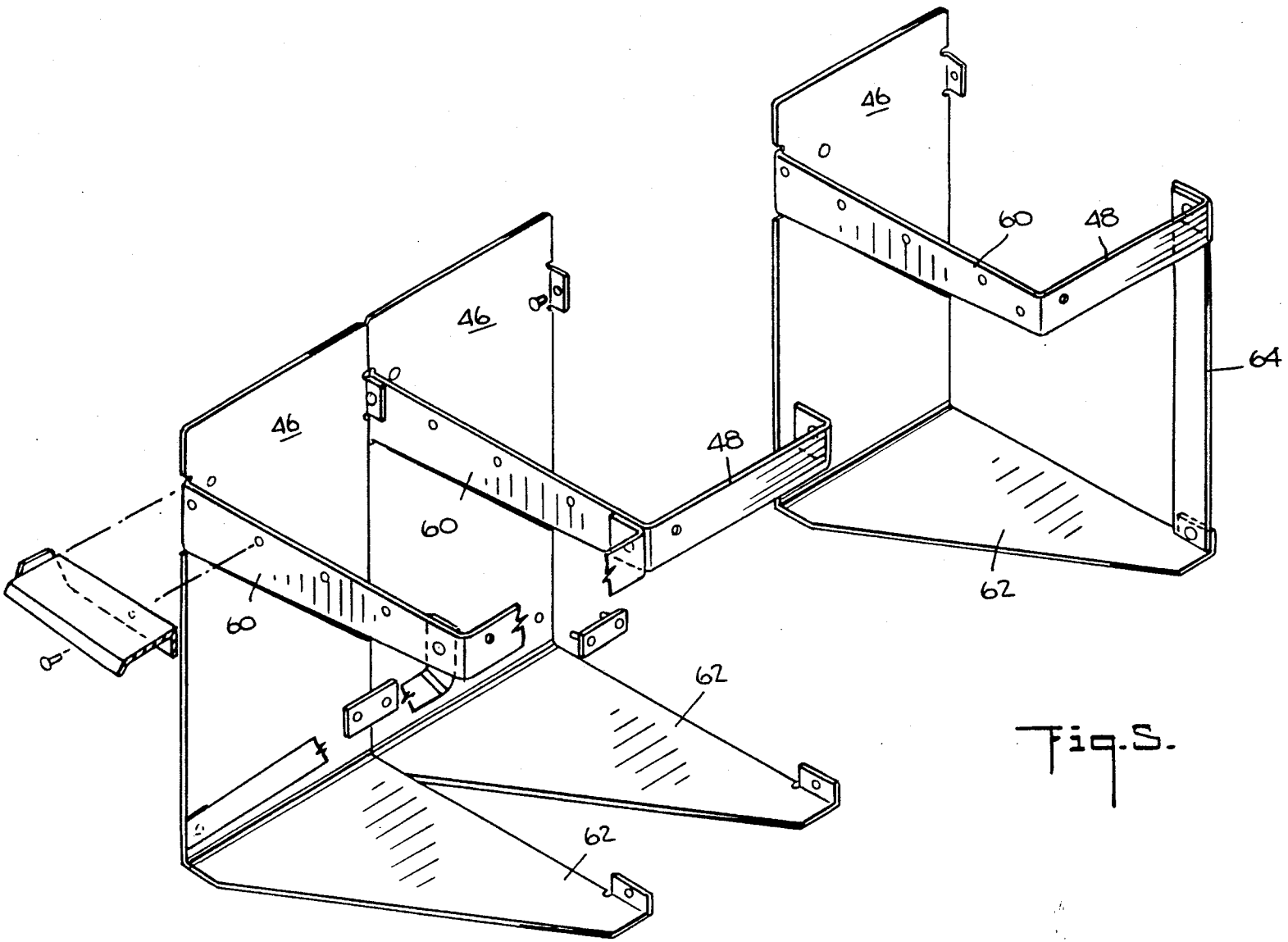
FIG. 5 is a perspective view showing the bracketry used to connect the universal modules.

The supporting structure for the transport path defined by the panels 38 and 50 can best be seen in FIGS. 4 and 5. The rear panel 46 is connected to the front panel 48 by a side panel 60. Each of the modules also includes a bottom panel 62 extending transversely from the bottom of the rear panel 46. Depending on how the module is deployed, there may be a straight leg 64 extending from the front side of the side panel 60 to the bottom panel 62, or on an angled leg 66 extending from the side panel 60 to the rear panel 46.

Figure 10:
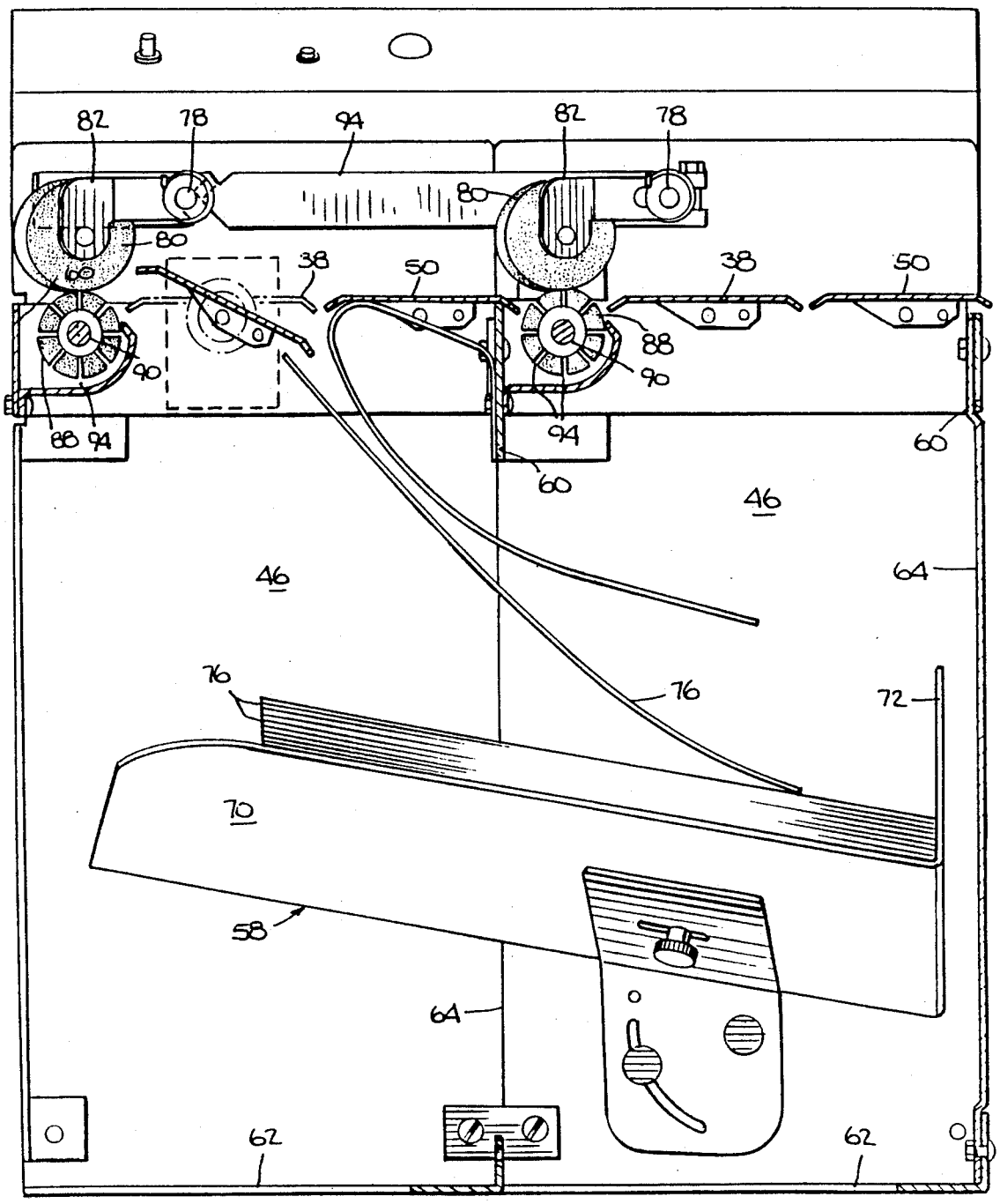
FIG. 10 is a sectional view taken on the plane indicated by the line 10—10 in FIG. 9.
Figure 13:
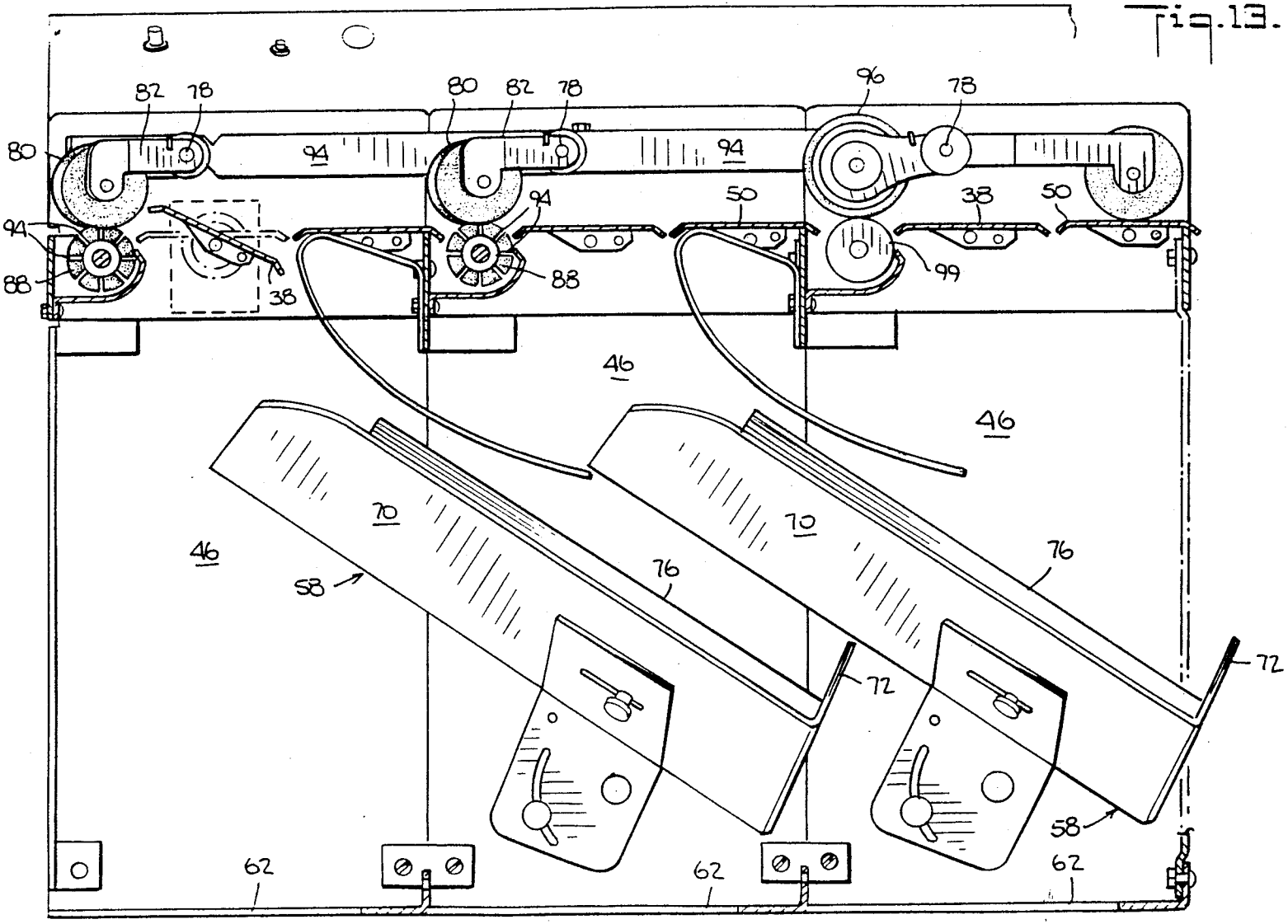
FIG. 13 is a vertical sectional view taken on the plane indicated by the line 13—13 in FIG. 12 but the upstream deflectable panel is shown opened to permit an envelope to be directed to the upstream stacking bin.

Each module is capable of being fitted with a stacking chamber 58 consisting of an angled bottom tray 70 and a front wall 72. As best seen in FIGS. 10 and 13, a pair of modules must be connected together to create enough space in the direction of transport for the deployment of a stacking chamber 58.

Associated with each module 28, 30, 32, 34 and 36 is a roller assembly generally designated 74 for transporting and aligning along the rear frame 46 a series of envelopes 6. Each roller assembly 74 includes a supporting shaft 78 fixedly mounted in the rear frame 46 for supporting a pair of top, idler rollers 80, each of which is rotatably mounted on a pivotable lever arm 82. A pair of torsion springs 84 are mounted on the shaft 78 and are attached to each arm 82 and a pair of disks 86 also fixedly secured to the shaft 78. A resultant clockwise movement is therefore applied to each roller 80 and a normal force is applied to a pair of lower, driven rollers 88 associated with each of top rollers 80. The lower, driven rollers 88 are fixedly mounted on a drive shaft 90 journalled in the frames 46 and 48 The lever arm 82 has an end portion **82*a* which is bent at about a 10 degree angle with respect to its major longitudinal direction which is substantially parallel to the rear frame 46. The result is that the axis of the roller 80 is oriented at about 10 degrees with respect to the shaft 90 and roller 88. Although the lower rollers 88 are the driven rollers, the top rollers 80 could be driven and the bottom rollers 88** be the idler rollers.

Figure 2:
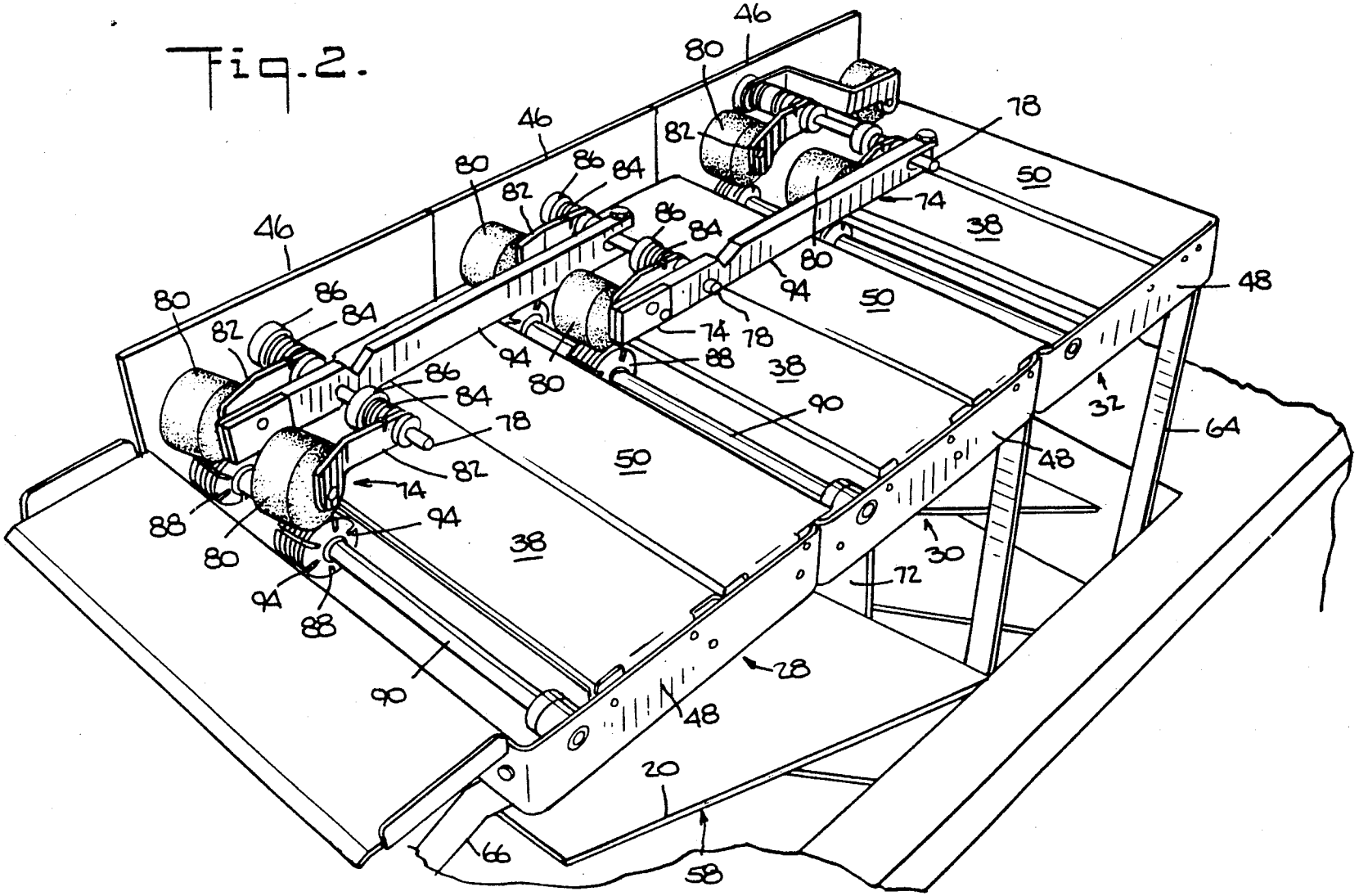
FIG. 2 is an enlarged perspective view of the two upstream units seen in FIG. 1.
Figure 3:
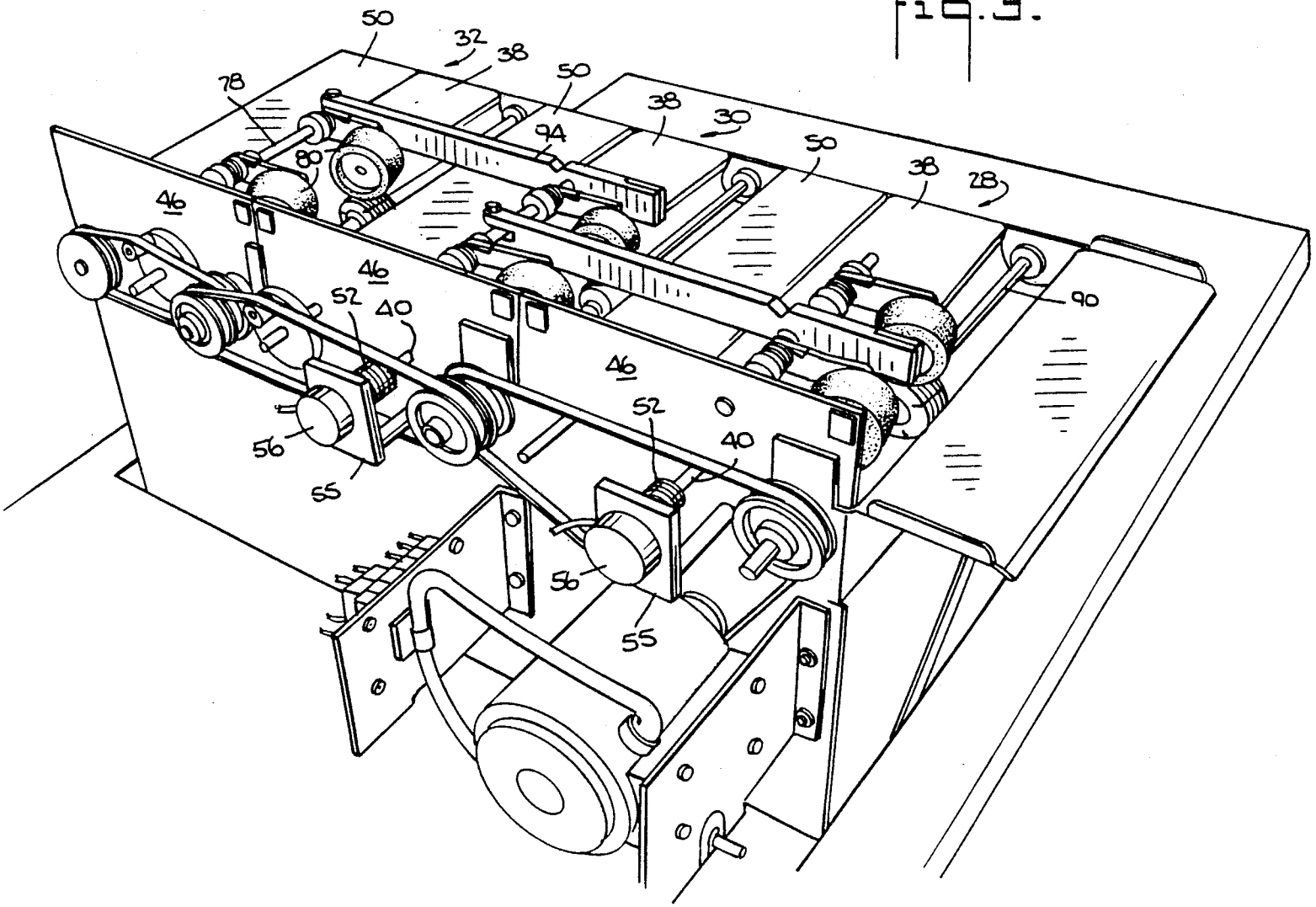
FIG. 3 is an enlarged perspective view of the units seen in FIG. 2 but the view is from the opposite side of the apparatus shown.
Figure 11:
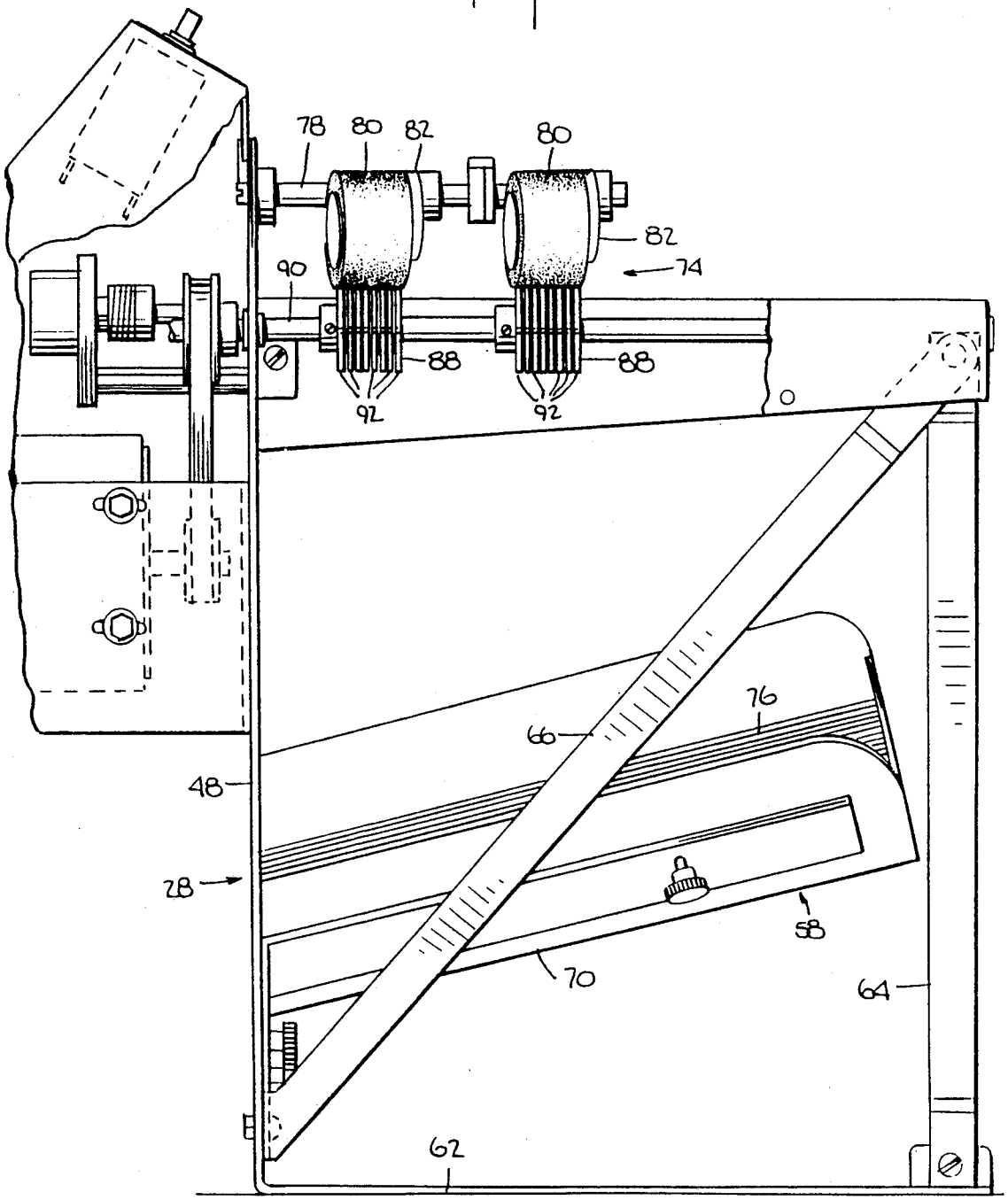
FIG. 11 is an elevational view of the upstream end of the upstream module forming part of the upstream unit seen in FIG. 1.

The lower rollers 88 includes an elastomeric cover which is divided into a plurality of disks 92 (see FIG. 11) separated by lateral grooves uniformly spaced across the width of the roller 88 to permit lateral deflection thereof. As best seen in FIGS. 2, 10 and 13, the lower roller also includes radial slots 94 which divide each of the disks 92 into radial segments equally about their circumference. The radial segments resemble flower petals which easily bend laterally when so influenced. As best seen in FIGS. 1–3, a stabilizing yoke 94 may be used in order to connect adjacent supporting shafts 78 so that the top rollers 80 are further stabilized.

Figure 12:
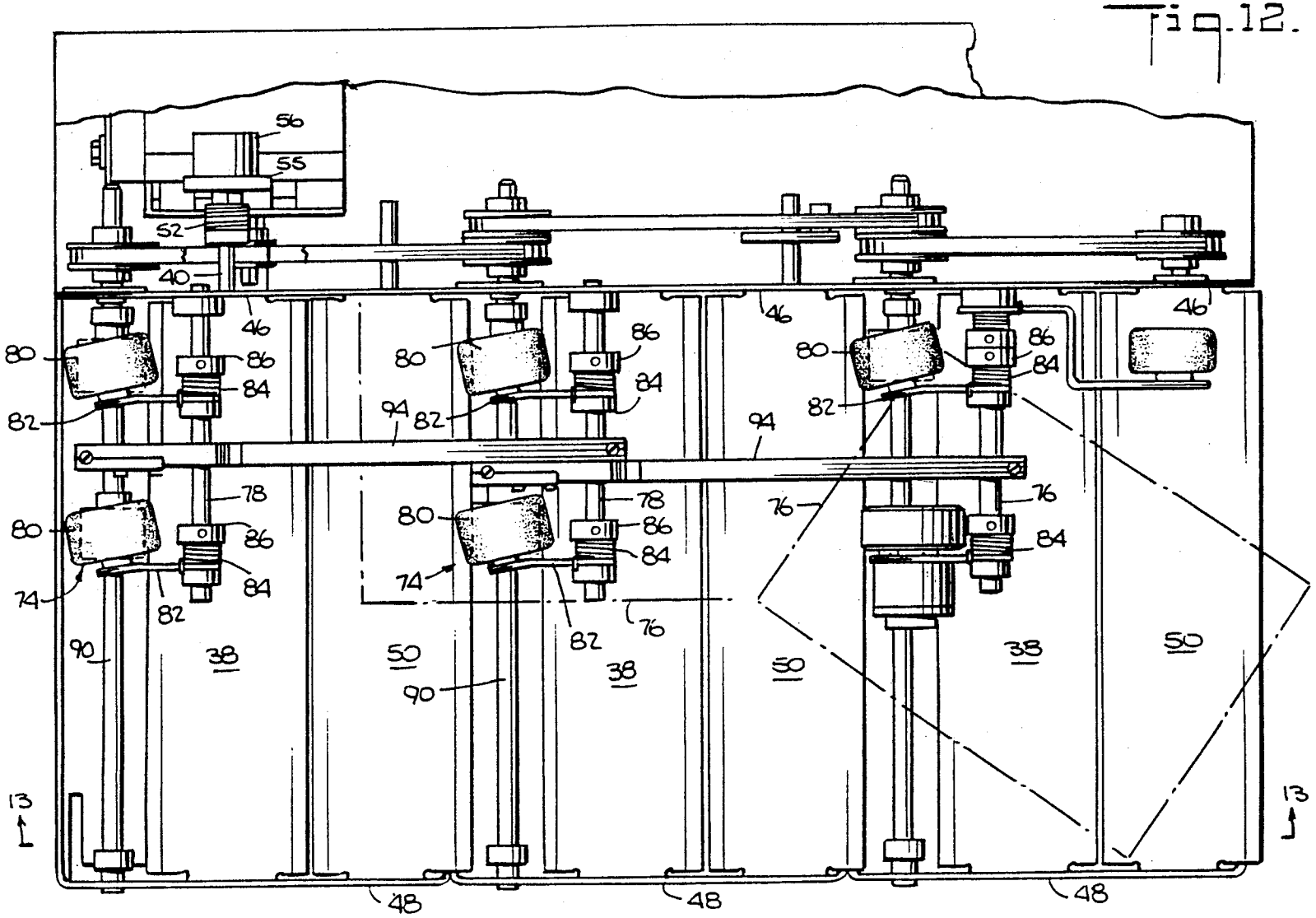
FIG. 12 is a top plan view of three universal modules connected in which the downstream module employs a top, braking roller which is stopped to turn an envelope and thus denote the end of a particular grouping of envelopes.

Referring now to FIGS. 12–16, the top roller nearest the front frame 48 comprises a straight, braking roller 96 which is controlled by an electronic brake 98. Cooperating with the braking roller 96 is a lower, driven, steel roller 99. When it is desired to mark the end of a particular grouping of envelopes 76, such as all those bearing the same zip code, the transporting system 20, by means of markings on the envelopes 76 and sensing devices responsive to those markings, causes the electronic brake 98 to effect a momentary stoppage of the braking roller 96. The lower, driven steel roller 99 continues to rotate, but because the top roller is braked, the lower roller 99 just slips beneath the envelope 76 without engaging it. The result is that only the inside rollers 80 and 88 engage the envelope 76, which causes the envelope 76 to be rotated as seen in FIG. 12, thereby distinguishing the rotated envelope 76 from the balance of the envelopes 76 being processed. The use of the braking roller 96 to mark an envelope is especially useful in the case of those envelopes 76 which are defectively filled with inserts. In such a case, typically the defective envelope 76 would be diverted to one of the stacking chambers 58, where it would subsequently be manually removed and checked for the proper inserts, but then if it were desired to restore the removed envelope 76 to its original place in the original grouping, an additional effort would be required by the machine operator. If the defective envelope 76 is simply marked by being turned as by the braking roller 96, then no additional effort is required to restore the marked envelope 76 to its original position in the grouping.

Figures 6, 7, 8:
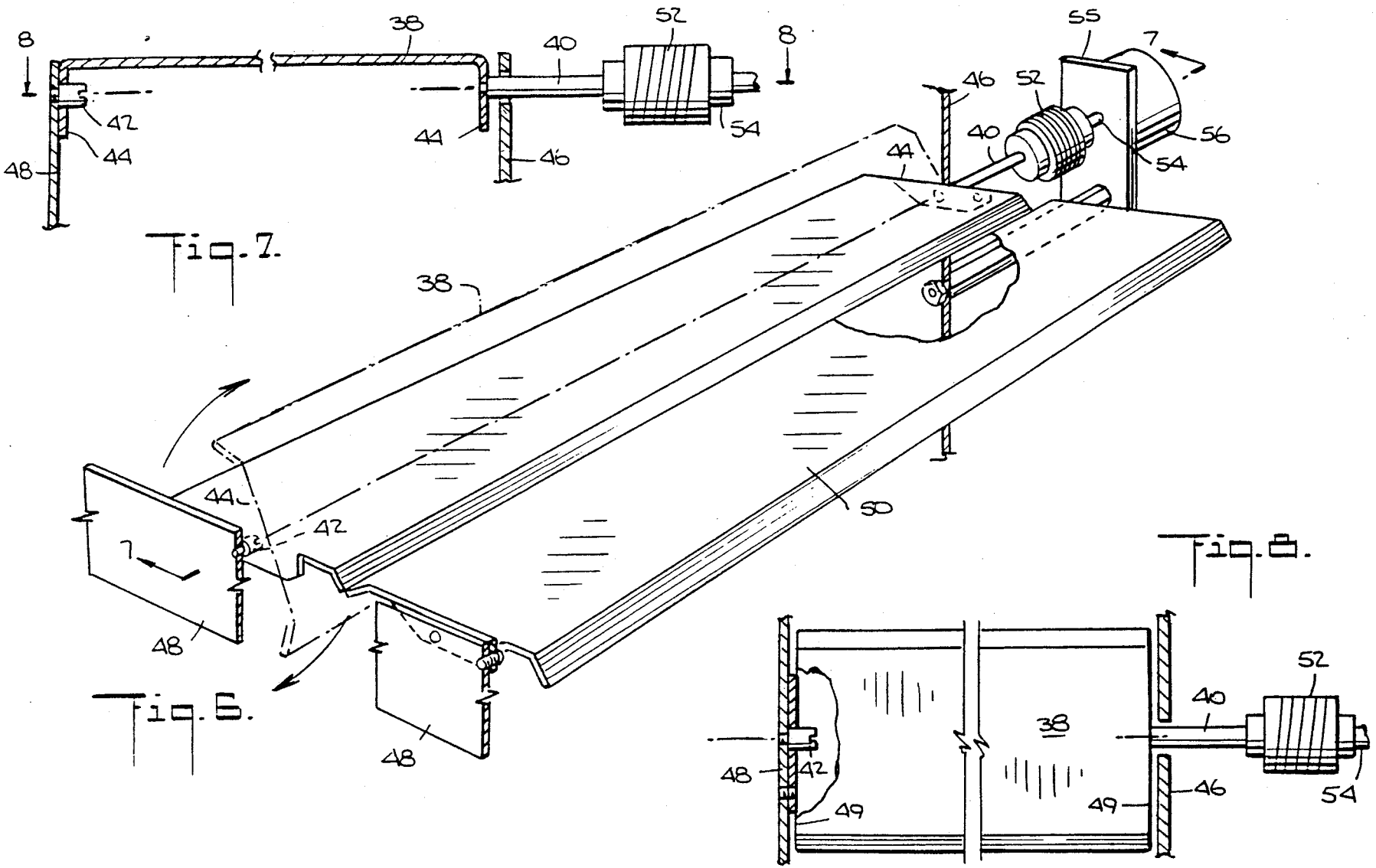
FIG. 6 is an enlarged, perspective view showing the universal module transport deck and the drive for a pivotable panel in the deck of the universal module.
FIG. 7 is a sectional view taken on the plane indicated by the line 7—7 in FIG. 6.
FIG. 8 is a sectional view taken on the plane indicated by the line 8—8 in FIG. 7.
Figure 9:
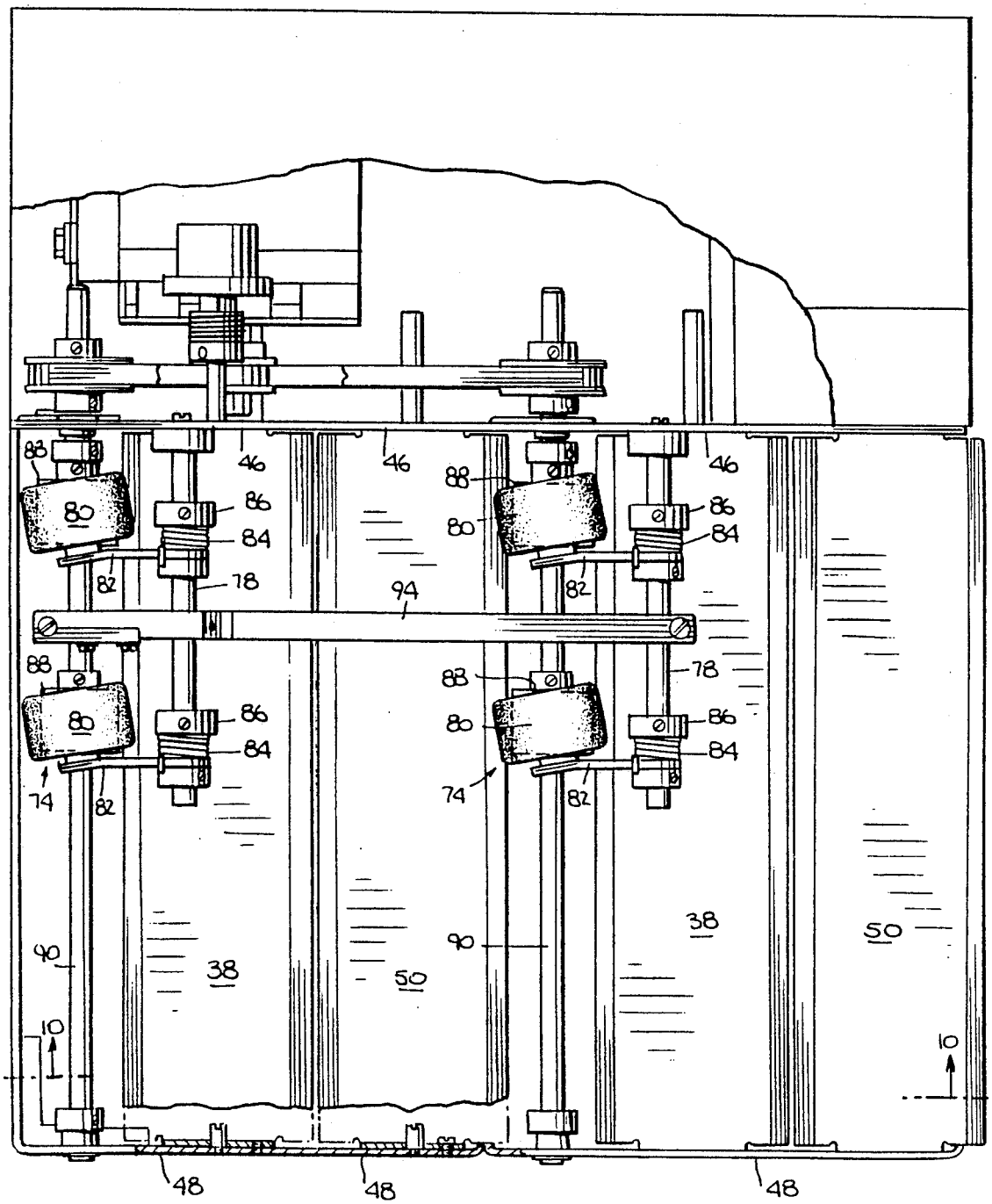
FIG. 9 is a top plan view of the downstream unit seen in FIG. 1 consisting of a pair of universal modules hooked together.

The operational capacities of the modules 28, 30, 32, 34 and 36 will now be explained. Clearly, when the pivotable deck panel 38 is in the horizontal position, the aforesaid modules function as a transport surface for the envelopes 76. This transport surface can be situated adjacent or between any other type of module, such as the mailing machine 22, or an inserting machine or an envelope turning device. The rollers 80 and 88 in combination with the rear frame 46 provide the capability of aligning the envelopes 76 so that they are properly registered prior to the printing thereon of postage, as, for example, by the postage meter 26. Because of the presence of the pivotable panel 38, it is possible to divert envelopes underneath the panel 38 when it is tilted to an acute angle of about 30 to 45 degrees as seen in FIGS. 6, 10 and 13. When the panel 38 is so tilted, the envelope 76 passes beneath the panel 38 into one of the stacking chambers 70 for subsequent manual handling. Thus it can be seen that the module of the instant invention can be used for transporting, aligning and stacking of envelopes and can be deployed in a variety of environments.

It should be understood by those skilled in the art that various modifications may be made in the present invention without departing from the spirit and scope thereof, as described in the specification and defined in the appended claims.

What is claimed is:

1. A transport deck module for transporting aligning and diverting envelopes, comprising:

a housing frame, said housing frame including a registration wall;

a roller assembly secured to said housing frame for transporting the envelopes across the transport deck module and for aligning the envelopes against said registration wall;

a pivotable deck panel, pivotably secured to said housing and situated downstream and adjacent said roller assembly;

a fixed deck panel secured to said housing and situated downstream and adjacent said pivotable deck panel; and means for coupling a fixed panel side of said module to a roller assembly side of a similar transport deck module whereby a continuous transport deck comprising a plurality of transport deck modules for transporting, aligning and diverting the envelopes is formed.

2. The transport deck module in accordance with claim 1, further comprising stacking means secured to said housing and situated beneath said pivotable and fixed deck panels for stacking envelopes diverted by said pivotable deck panel.

3. The module of claim 1, wherein said pivotable deck panel includes a central axis perpendicular to said registration wall, and said pivotable deck panel is pivotable to an acute angle about said central axis.

4. The module of claim 3, wherein said acute angle is between about 30 an 45 degrees.

5. The module of claim 4, wherein said roller assembly includes a top roller and a lower roller, said lower roller having an axis perpendicular to said registration wall and said top roller having an axis oriented at an acute angle to said axis of said lower roller along a horizontal plane of the transport deck module.

6. The module of claim 5, wherein said axis of said top roller is oriented at an angle of about ten degrees with respect to said axis of said lower roller.

7. The module of claim 5, wherein said lower roller comprises a driven roller and said top roller comprises an idler roller.

8. The module of claim 5, wherein said lower roller includes an elastomeric cover divided into a plurality of disks.

9. The module of claim 8, wherein each of said disks includes a plurality of radial slots.

10. A universal modular transport system for transporting, aligning, diverting and stacking envelopes, comprising:

a plurality of modular units, each of said modular units including a housing frame, a registration wall secured to said housing frame, a roller assembly secured to said housing frame for transporting the envelopes in a downstream direction and for aligning the envelopes against said registration wall, a pivotable deck panel pivotably secured to said housing frame and situated downstream and adjacent from said roller assembly, a fixed deck panel secured to said housing frame and situated downstream and adjacent said pivotable deck panel;

means for coupling a fixed panel side of an upstream modular unit to a roller assembly side of downstream modular unit whereby a continuous transport deck for transporting, aligning and diverting the envelopes is formed.

11. The universal modular transport system in accordance with claim 10 further comprising stacking means secured to the housing of at least one of the modular units for stacking envelopes diverted by said pivotable deck panel of said one of the modular units.

12. The universal modular transport system in accordance with claim 11, wherein said stacking means comprises a stacking chamber situated beneath said pivotable and fixed deck panels of two adjacent modular units.

13. The universal modular transport system in accordance with claim 11 wherein the number of modular units coupled together and the number and location of said stacking means is determined by each particular transport deck application.

* * * * *